US008676076B2

(12) United States Patent
Ohhashi et al.

(10) Patent No.: US 8,676,076 B2
(45) Date of Patent: Mar. 18, 2014

(54) HEATING CONTROLLING DEVICE, HEATING DEVICE, IMAGE FORMING DEVICE, PROGRAM STORAGE MEDIUM, AND METHOD

(75) Inventors: Takashi Ohhashi, Kanagawa (JP); Takanori Sasaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 357 days.

(21) Appl. No.: 12/792,310

(22) Filed: Jun. 2, 2010

(65) Prior Publication Data

US 2011/0142467 A1 Jun. 16, 2011

(30) Foreign Application Priority Data

Dec. 10, 2009 (JP) ..... 2009-280918

(51) Int. Cl.
*G03G 15/20* (2006.01)

(52) U.S. Cl.
USPC ..... 399/67; 399/77

(58) Field of Classification Search
USPC ..... 399/67, 70, 77
See application file for complete search history.

(56) References Cited

U.S. PATENT DOCUMENTS

| | | | | |
|---|---|---|---|---|
| 5,978,618 | A * | 11/1999 | Yamamoto et al. | 399/69 |
| 6,038,412 | A * | 3/2000 | Hiraoka | 399/69 |
| 2006/0198646 | A1 * | 9/2006 | Funabiki et al. | 399/45 |
| 2008/0131160 | A1 * | 6/2008 | Mitsuoka et al. | 399/70 |

FOREIGN PATENT DOCUMENTS

| | | |
|---|---|---|
| JP | A-2001-117409 | 4/2001 |
| JP | A-2009-020463 | 1/2009 |
| JP | A-2009-229792 | 10/2009 |

OTHER PUBLICATIONS

Sep. 10, 2013 Notice of Reasons for Rejection issued in Japanese Patent Application No. 2009-280918 (with translation).

* cited by examiner

*Primary Examiner* — Benjamin Schmitt
(74) *Attorney, Agent, or Firm* — Oliff & Berridge, PLC

(57) ABSTRACT

There is provided a heating controlling device having: a receiving section receiving heating instructions for plural heaters; and a controller that, when the receiving section receives a heating instruction to heat another heater while two or more heaters other than the heater for which the heating instruction is received are heating, stops heating of the heaters that are heating, after a first predetermined time period elapses from the control to stop heating, starts heating of the heater for which the heating instruction is received, and each time a number of second predetermined time periods elapses from the control to start heating, restarts heating, on the basis of predetermined priority rankings, of the heaters that were controlled to stop heating.

20 Claims, 14 Drawing Sheets

FIG.6

| PRIORITY RANKINGS | LAMP NAME |
|---|---|
| 1 | FIRST MAIN LAMP FOR OUTER HEATING ROLLER |
| 2 | FIRST MAIN LAMP FOR HEATING ROLLER |
| 3 | FIRST MAIN LAMP FOR INNER HEATING ROLLER |
| 4 | SECOND MAIN LAMP FOR OUTER HEATING ROLLER |
| 5 | SECOND MAIN LAMP FOR HEATING ROLLER |
| 6 | SECOND MAIN LAMP FOR INNER HEATING ROLLER |
| 7 | SUB LAMP FOR OUTER HEATING ROLLER |
| 8 | SUB LAMP FOR HEATING ROLLER |
| 9 | FIRST SUB LAMP FOR INNER HEATING ROLLER |
| 10 | SECOND SUB LAMP FOR INNER HEATING ROLLER |

HEATING CONTROLLING DEVICE, HEATING DEVICE, IMAGE FORMING DEVICE, PROGRAM STORAGE MEDIUM, AND METHOD

CROSS-REFERENCE TO RELATED APPLICATION

This application is based on and claims priority under 35 USC 119 from Japanese Patent Application No. 2009-280918 filed on Dec. 10, 2009.

BACKGROUND

1. Technical Field

The present invention relates to a heating controlling device, a heating device, an image forming device, a program storage medium, and a method.

2. Related Art

Image forming devices equipped with halogen heaters are used conventionally.

SUMMARY

A heating controlling device relating to an aspect of the present invention has: a receiving section receiving heating instructions for plural heaters; and a controller that, when, while two or more heaters among the plural heaters are heating, the receiving section receives a heating instruction for another heater, stops heating of the heaters that are heating, and, after a first predetermined time period elapses from stopping of heating, starts heating of the heater for which the receiving section received the heating instruction, and, each time a number of second predetermined time periods elapses from starting of heating, re-starts, on the basis of predetermined priority rankings, heating of the heaters at which heating has been stopped.

BRIEF DESCRIPTION OF THE DRAWINGS

An exemplary embodiment of the present invention will be described in detail based on the following figures, wherein:

FIG. 6 is an explanatory drawing for explaining the predetermined priority list of the halogen lamps in the order by which they are respectively lighted relating to the present exemplary embodiment;

DETAILED DESCRIPTION

Note that the present exemplary embodiment does not limit the present invention.

Figure 1:
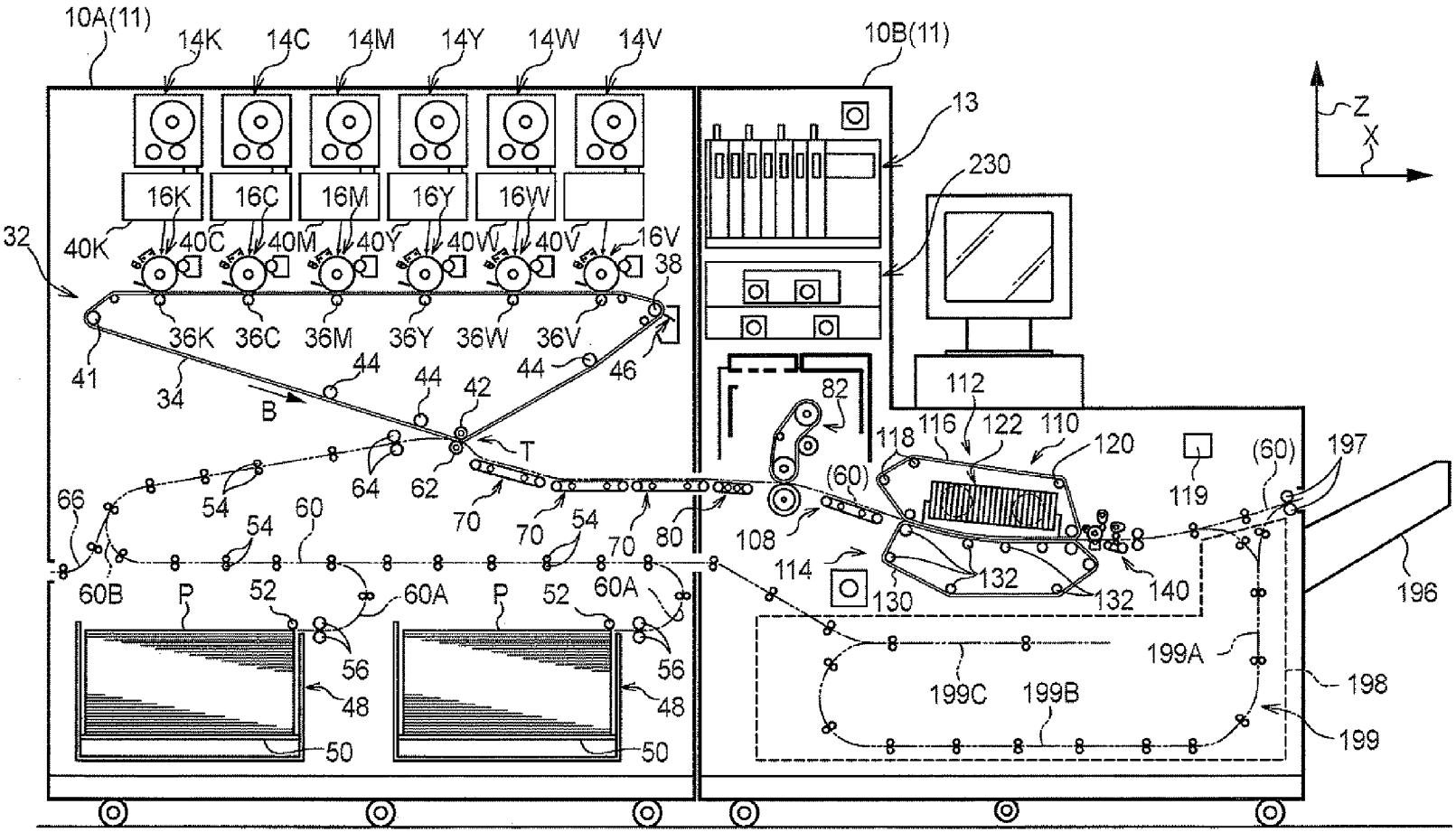
FIG. 1 is a block diagram showing an example of the schematic structure of an overall image forming device relating to the present exemplary embodiment.

First, an image forming device relating to the present exemplary embodiment is described. FIG. 1 is a block diagram showing an example of the schematic structure of an overall image forming device relating to the present exemplary embodiment.

As shown in FIG. 1, an image forming device 10 relating to the present exemplary embodiment forms color images or black-and-white images. The image forming device 10 has a first processing section 10A that is disposed at the left side as seen in front view, and a second processing section 10B that is disposed at the right side and can be attached to and removed from the first processing section 10A. The housings of the first processing section 10A and the second processing section 10B are structured by plural frame members 11.

A control section 13 is provided within the second processing section 10B at the upper side in the vertical direction. The control section 13 includes an image signal processing section that carries out image processing on image data that is sent-in from a computer, and is an example of a driving section that carries out driving control of the respective sections of the image forming device 10. A power source unit 230 is provided beneath the control section 13. The power source unit 230 changes alternating current, that is taken-in from the exterior, into direct current, and supplies electricity to the respective sections of the image forming device 10.

On the other hand, toner cartridges 14V, 14W, 14Y, 14M, 14C, 14K are provided so as to be lined-up in the horizontal direction, within the first processing section 10A at the upper side in the vertical direction. The toner cartridges 14V, 14W, 14Y, 14M, 14C, 14K accommodate respective toners of a first particular color (V), a second particular color (W), yellow (Y), magenta (M), cyan (C), black (K). Note that the first particular color and the second particular color are selected from particular colors (including transparent) other than yellow, magenta, cyan and black. Note that, in the following description, when differentiating among V, W, Y, M, C, K, the corresponding letter V, W, Y, M, C, K is appended to the reference numeral. When general description is given without differentiating among V, W, Y, M, C, K, the letter V, W, Y, M, C, K is omitted.

Six image forming units 16, that serve as examples of image forming sections corresponding to the toners of the respective colors, are provided so as to be lined-up in the horizontal direction in correspondence with the respective toner cartridges 14 beneath the toner cartridges 14. An exposure unit 40, that serves as an example of an image forming section, is provided beneath each toner cartridge 14 at each image forming unit 16. The exposure unit 40 receives image data, that has been subjected to image processing, from the control section 13, and modulates a semiconductor laser (not shown) in accordance with color material gradation data, and emits exposure light L from the semiconductor laser. Specifically, the exposure units 40 irradiate the exposure lights L, that correspond to the respective colors, onto the surfaces of photoreceptors 18 (see FIG. 2) that will be described later, and form electrostatic latent images on the photoreceptors 18.

Figure 2:
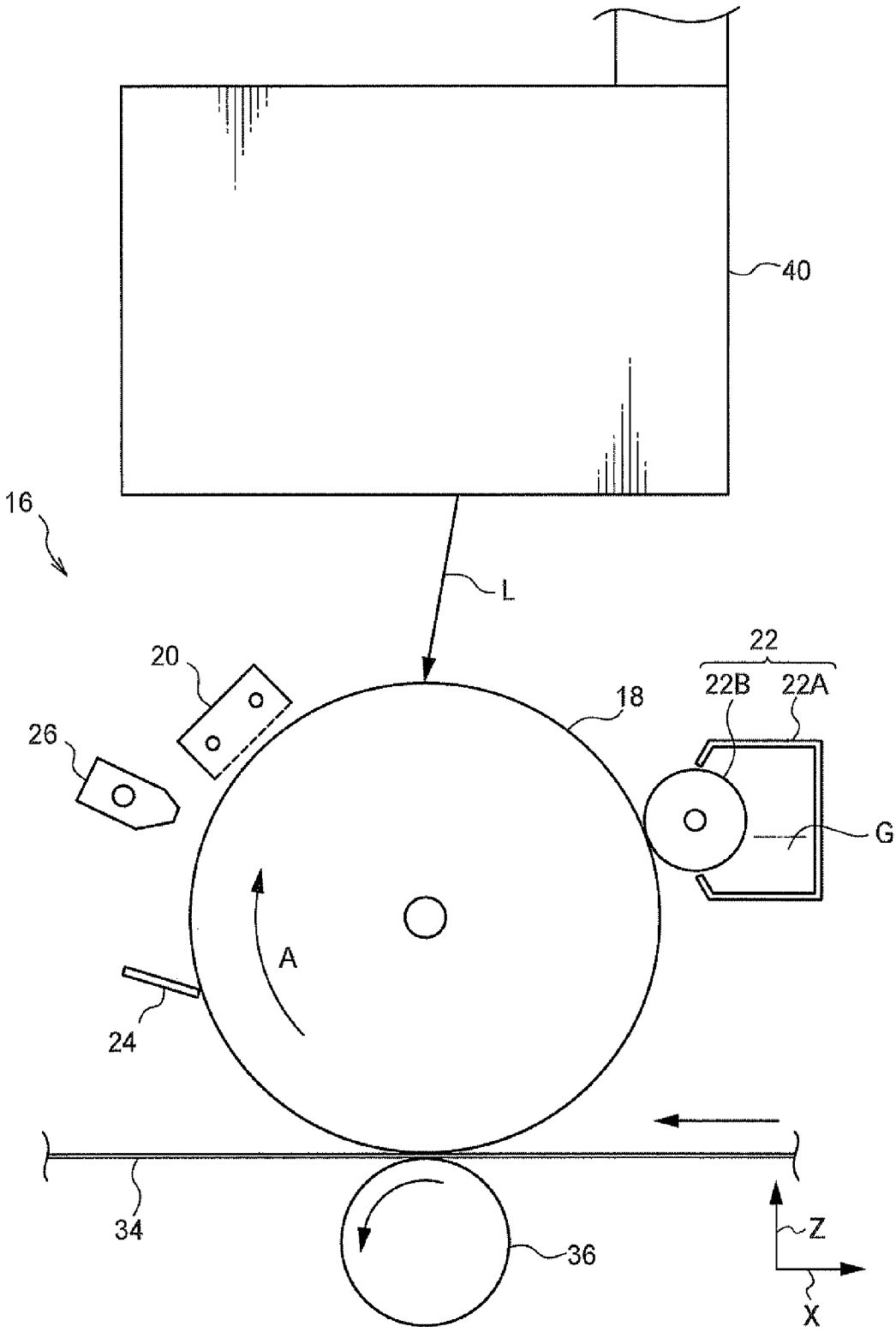
FIG. 2 is a structural drawing showing an example of the schematic structure of an image forming unit relating to the present exemplary embodiment.

An example of the schematic structure of the image forming unit relating to the present exemplary embodiment is shown in FIG. 2. As shown in FIG. 2, the image forming unit 16 has the photoreceptor 18 that is driven and rotated in the direction of arrow A (clockwise in FIG. 2). A scorotron charger 20, a developing device 22, a cleaning blade 24 and an erase lamp 26 are provided at the periphery of the photoreceptor 18. The scorotron charger 20 is a corona discharge type (non-contact charging type) charger that charges the photoreceptor 18. The developing device 22 develops, by a developer (toner) of the corresponding color, the electrostatic latent image that is formed on the photoreceptor by the exposure light L emitted by the exposure unit 40. The cleaning blade 24 cleans the surface of the photoreceptor 18 after transfer. The erase lamp 26 illuminates light onto the surface of the photoreceptor 18 after transfer, so as to carry out charge removal. The scorotron charger 20, the developing device 22, the cleaning blade 24 and the erase lamp 26 are disposed so as to face the surface of the photoreceptor 18, in that order from the rotating direction upstream side toward the downstream side of the photoreceptor 18.

The developing device 22 has a developer accommodating member 22A and a developing roller 22B. The developer accommodating member 22A is disposed at the side of the image forming unit 16 (in the present exemplary embodiment, at the right side in the drawings), and a developer G that contains toner is filled therein. The developing roller 22B moves the toner, that is filled in the developer accommodating member 22A, onto the surface of the photoreceptor 18. The developer accommodating member 22A is connected to the toner cartridge 14 (see FIG. 1) through a toner supply path (not shown), and toner is supplied from the toner cartridge 14.

As shown in FIG. 1, a transfer section 32 is provided beneath the respective image forming units 16. The transfer section 32 includes an intermediate transfer belt 34 and primary transfer rollers 36. The intermediate transfer belt 34 is an endless belt that contacts the respective photoreceptors 18. The primary transfer rollers 36 are disposed at the inner side of the intermediate transfer belt 34, and function as six primary transfer members that transfer, in a superposed manner and onto the intermediate transfer belt 34, the toner images that are formed on the respective photoreceptors 18. The intermediate transfer belt 34 is trained around a driving roller 38 that is driven by a motor (not shown), a tension imparting roller 41 that adjusts the tension of the intermediate transfer belt 34, a supporting roller 42 that is disposed so as to face a secondary transfer roller 62 that will be described later, and plural supporting rollers 44. The intermediate transfer belt 34 is circulated in the arrow 8 direction (counterclockwise) in FIG. 1 by the driving roller 38.

Specifically, the respective primary transfer rollers 36 are disposed so as to oppose the photoreceptors 18 of the respective image forming units 16, with the intermediate transfer belt 34 nipped therebetween. A transfer bias voltage, that is the opposite polarity of the toner polarity, is applied to the primary transfer rollers 36 by an electricity supplying unit (not shown). Due to this structure, the toner images formed on the photoreceptors 18 are transferred onto the intermediate transfer belt 34. Further, a cleaning blade 46, whose distal end portion contacts the intermediate transfer belt 34, is provided at the opposite side of the driving roller 38 with the intermediate transfer belt 34 sandwiched therebetween. The cleaning blade 46 removes residual toner, paper dust, and the like that are on the intermediate transfer belt 34 that circulates.

On the other hand, two large sheet feed cassettes 48, that house sheet members P serving as examples of recording media, are provided so as to be lined-up in the horizontal direction at the lower side of the first processing section 10A beneath the transfer section 32. The sheet members P are accommodated in the sheet feed cassettes 48. Note that, because the two sheet feed cassettes 48 are structured substantially similarly, description is given of one of the sheet feed cassettes 48, and description of the other sheet feed cassette 48 is omitted.

The sheet feed cassette 48 can be pulled-out freely from the first processing section 10A. When the sheet feed cassette 48 is pulled-out from the first processing section 10A, a bottom plate 50 is lowered due to the instruction of a control section (illustration of which is omitted). The bottom plate 50 is provided within the sheet feed cassette 48, and the sheet members P are placed thereon. Due to the bottom plate 50 being lowered, the sheet members P are refilled by a user. Further, when the sheet feed cassette 48 is set in the first processing section 10A, the bottom plate 50 rises up due to the instruction of the control section. A feed-out roller 52, that feeds the sheet member P out from the sheet feed cassette 48 to a conveying path 60, is provided above one end side of the sheet feed cassette 48. The uppermost sheet member P on the bottom plate 50 that has been raised-up, and the feed-out roller 52 contact one another. Further, separating rollers 56, that prevent the multiple-feeding of the sheet members P that are superposed one on another, are provided at the sheet member conveying direction downstream side (hereinafter simply called "downstream side") of the feed-out roller 52. Plural conveying rollers 54, that convey the sheet member P toward the conveying direction downstream side, are provided at the downstream side of the separating rollers 56.

The conveying path 60 that is provided above the sheet feed cassettes 48 turns the sheet member P, that is fed-out from the sheet feed cassette 48, back toward the opposite side (the left side in the drawing) at a first turn-back section 60A, and further, turns the sheet member P back toward the opposite side (the right side in the drawing) at a second turn-back section 60B, and extends toward a transfer position T that is nipped by the secondary transfer roller 62 and the supporting roller 42.

An aligner (not shown), that corrects the tilting and the like of the sheet member P that is being conveyed, is provided at the region located between the second turn-back portion 60B and the transfer position T. Registration rollers 64, for causing the timing of the movement of the toner image on the intermediate transfer belt 34 and the timing of the conveying of the sheet member P to match, are provided at the region located between the aligner and the transfer position T.

A transfer bias voltage of the opposite polarity as the toner polarity is applied by an electricity supplying unit (not shown) to the secondary transfer roller 62. Due to this structure, the toner images of the respective colors, that have been transferred onto the intermediate transfer belt 34 so as to be superposed one on another, are secondarily transferred onto the sheet member P that is conveyed-in along the conveying path 60 by the secondary transfer roller 62. Further, a reserve path 66, that extends from the side surface of the first processing section 10A, is provided so as to merge into the second turn-back portion 60B of the conveying path 60. The sheet member P, that is fed-out from a large-capacity stacking section (not shown) that is externally-mounted and is disposed adjacent to the first processing section 10A, is fed-in to the conveying path 60 through this reserve path 66.

On the other hand, plural conveying devices 70, that convey the sheet member P on which the toner image has been transferred toward the second processing section 10B, are provided at the downstream side of the transfer position T. The conveying devices 70 have plural belt members that are trained around driving rollers (omitted from illustration) and driven rollers. By driving and rotating the driving rollers and rotating the belt members, the sheet member P is conveyed toward the downstream side.

The downstream side of the conveying devices 70 extends from the first processing section 10A toward the second processing section 10B. The sheet member P, that is fed-out by the conveying devices 70, is received by a conveying device 80 that is provided at the second processing section 10B, and is conveyed further downstream. A fixing unit 82, that serves as an example of a fixing device that fixes the toner image, that was transferred on the surface of the sheet member P, onto the sheet member P by heat and pressure, is provided at the downstream side of the conveying device 80.

Figure 3:
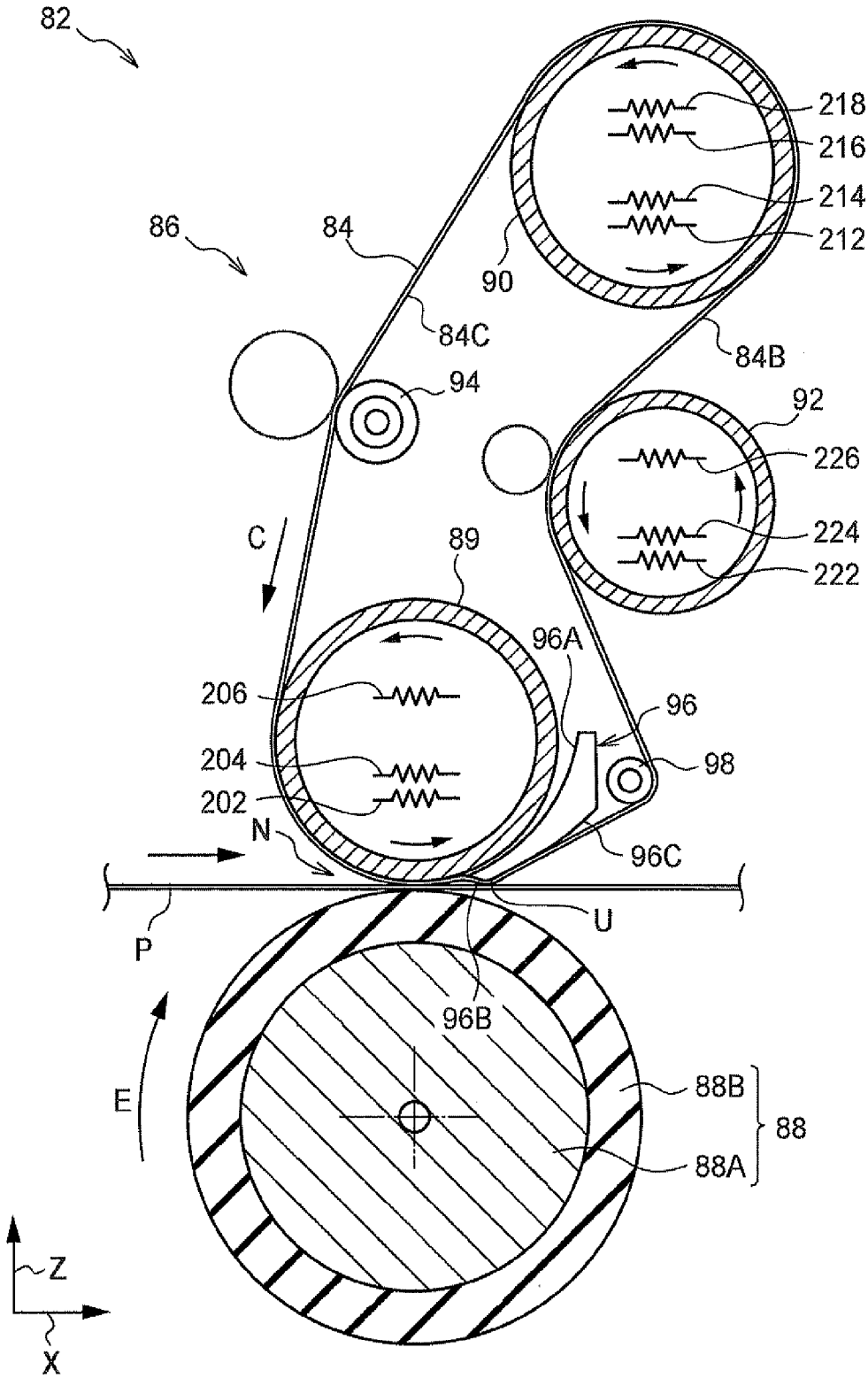
FIG. 3 is a structural drawing showing an example of the schematic structure of a fixing unit relating to the present exemplary embodiment.

An example of the schematic structure of the fixing unit relating to the present exemplary embodiment is shown in FIG. 3. As shown in FIG. 3, the fixing unit 82 is structured by a fixing belt module 86 having a fixing belt 84, and a pressure-applying roller 88 that is disposed so as to press-contact the fixing belt module 86. A nip portion N, that is contacted by the fixing belt 84 (the fixing belt module 86) that will be described later and the pressure-applying roller 88, is formed. At the nip portion N, pressure is applied to the sheet member P and the sheet member P is heated, such that the toner image is fixed thereon.

The fixing belt module 86 has the fixing belt 84, a heating roller 89, and an inner heating roller 90. The fixing belt 84 is an endless belt. The heating roller 89 is driven and rotated by the rotating force of a motor (not shown) while stretching the fixing belt 84 at the pressure-applying roller 88 side. The inner heating roller 90 stretches the fixing belt 84 from the inner side at a position that is different than that of the heating roller 89. Further, the fixing belt module 86 has an outer heating roller 92, that is disposed at the outer side of the fixing belt 84 and prescribes the path of circling of the fixing belt 84, and a posture correcting roller 94 that corrects the posture of the fixing belt 84 from the heating roller 89 to the inner heating roller 90.

A peeling pad 96 and a supporting roller 98 are provided at the inner side of the fixing belt 84 and at the downstream side region within the nip portion N that is the region that the fixing belt module 86 and the pressure-applying roller 88 press-contact. The peeling pad 96 is disposed at a position in the vicinity of the heating roller 89, and peels the fixing belt 84 off from the outer peripheral surface of the heating roller 89. The supporting roller 98 stretches the fixing belt 84 at the downstream side of the nip portion N.

The heating roller 89 is a hard roller at which a fluorine resin surface film of a thickness of 200 μm is formed on the surface of a metal core as a protective layer that prevents metal wear of the surface of the metal core that is shaped as a cylindrical tube and formed of aluminum. A first main lamp 202, a second main lamp 204 and a sub lamp 206 are provided as heating sources at the interior of the heating roller 89. The first main lamp 202, the second main lamp 204 and the sub lamp 206 are halogen lamps, and the lighting and extinguishing and the like thereof are controlled by a control section (details thereof are described later).

Further, the inner heating roller 90 is a cylindrical tubular roller formed of aluminum, and a first main lamp 212, a second main lamp 214, a first sub lamp 216 and a second sub lamp 218 are disposed at the interior thereof as heating sources. These lamps heat the fixing belt 84 from the inner side. The first main lamp 212, the second main lamp 214, the first sub lamp 216 and the second sub lamp 218 are halogen lamps, and the lighting and extinguishing and the like thereof are controlled by a control section (control device) (details thereof are described later). Moreover, spring members (not illustrated), that push the fixing belt 84 toward the outer side, are disposed at both end portions of the inner heating roller 90.

The outer heating roller 92 is a cylindrical tubular roller formed of aluminum. A releasing layer that is formed of a fluorine resin and has a thickness of 20 μm is formed on the surface of the outer heating roller 92. The releasing layer is formed in order to prevent offset toner and paper powder from the outer peripheral surface of the fixing belt 84 from accumulating on the outer heating roller 92. A first main lamp 222, a second main lamp 224 and a sub lamp 226 are disposed at the interior of the outer heating roller 92. These lamps heat the fixing belt 84 from the outer side. The first main lamp 222, the second main lamp 224 and the sub lamp 226 are halogen lamps, and the lighting and extinguishing and the like thereof are controlled by a control section (details thereof are described later). Namely, in the present exemplary embodiment, the fixing belt 84 is heated by the heating roller 89, the inner heating roller 90 and the outer heating roller 92. The fixing belt 84 of the present exemplary embodiment corresponds to a fixing section.

Figure 4:
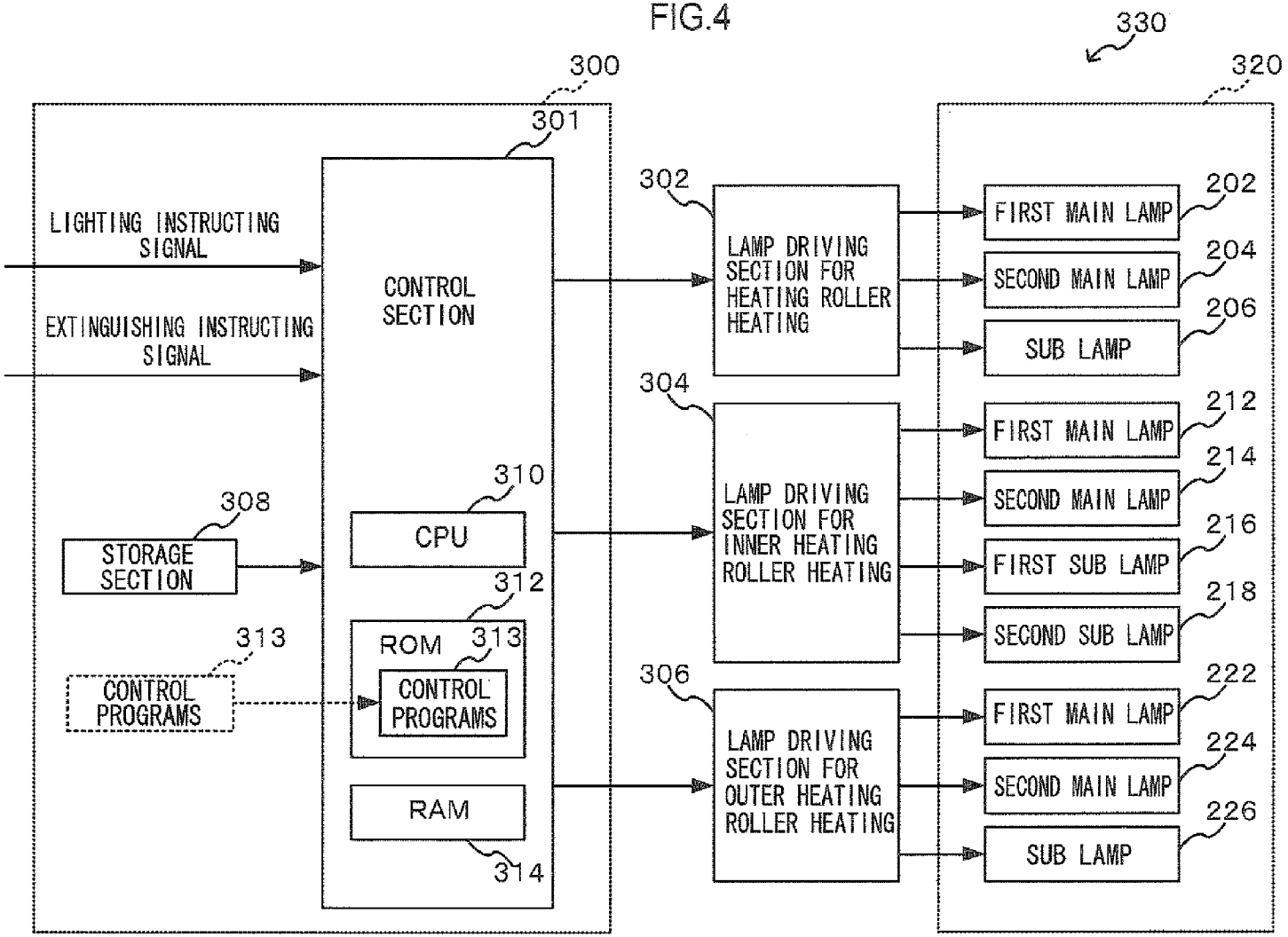
FIG. 4 is a block diagram showing an example of a heating device and a heating controlling device relating to the present exemplary embodiment.

A block diagram of an example of a heating device and a heating controlling device relating to the present exemplary embodiment is shown in FIG. 4.

A heating controlling device 300 of the present exemplary embodiment has a control section 301 and a storage section 308. Further, a heating device 330 of the present exemplary embodiment is structured to include the heating controlling device 300, a lamp driving section 302 for heating roller heating, a lamp driving section 304 for inner heating roller heating, a lamp driving section 306 for outer heating roller heating, the first main lamp 202, the second main lamp 204, the sub lamp 206, the first main lamp 212, the second main lamp 214, the first sub lamp 216, the second sub lamp 218, the first main lamp 222, the second main lamp 224, and the sub lamp 226. Note that, when referring in general to the first main lamp 202, the second main lamp 204, the sub lamp 206, the first main lamp 212, the second main lamp 214, the first sub lamp 216, the second sub lamp 218, the first main lamp 222, the second main lamp 224, and the sub lamp 226, they are simply called "halogen lamps 320". The halogen lamps 320 in the present exemplary embodiment correspond to heaters of the image forming device.

The control section 301 includes a CPU 310, a ROM 312 and a RAM 314. On the basis of lighting instructing signals and extinguishing instructing signals for the halogen lamps 320 that are received from the control section 13 of the image forming device 10 main body, the CPU 310 carries out control of the heating of the image forming device by the halogen lamps 320. Therefore, on the basis of the received lighting instructing signals and extinguishing instructing signals, the control section 301 sends lighting starting instructions and stop instructions to the halogen lamps 320 that correspond to the respective signals. Note that, in the present exemplary embodiment, it is considered that the halogen lamp 320 that is the destination of a lighting starting instruction is lit when the control section 301 sends the lighting starting instruction. Further, it is considered that the halogen lamp 320 that is the destination of a stop instruction is stopped (is not lit) when the control section 301 sends the stop instruction.

Control programs 313 of various types of control that are executed at the CPU 310 are stored in the ROM 312. The RAM 314 ensures an area for work at times when the control programs are executed by the CPU 310. Note that the control programs 313 may be stored on a storage medium such as a CD-ROM or the like, or may be stored in the ROM 312 or the storage section 308 or the like, and executed by the CPU 310. The storage section 308 stores in advance the priority rankings and start-up time differences of the halogen lamps 320 (both will be described in detail later), and the like. The control section 301 of the present exemplary embodiment corresponds to a receiving section and a controller.

The lamp driving section 302 for heating roller heating drives the first main lamp 202, the second main lamp 204 and the sub lamp 206 that are the heat sources of the heating roller 89, and has driving circuits and the like that correspond respectively thereto. The lamp driving section 304 for inner heating roller heating drives the first main lamp 212, the second main lamp 214, the first sub lamp 216 and the second sub lamp 218 that are the heat sources of the inner heating roller 90, and has driving circuits and the like that correspond respectively thereto. The lamp driving section 306 for outer heating roller heating drives the first main lamp 222, the second main lamp 224 and the sub lamp 226 that are the heat sources of the outer heating roller 92, and has driving circuits and the like that correspond respectively thereto.

As shown in FIG. 3, the posture correcting roller 94 is a solid-cylindrical roller that is fanned of aluminum. An end portion position measuring mechanism (not illustrated), that measures the end portion position of the fixing belt 84, is disposed in a vicinity of the posture correcting roller 94. An axially displacing mechanism (not shown), that displaces the abutting position of the fixing belt 84 in the axial direction in accordance with the results of measurement of the end portion position measuring mechanism, is disposed at the posture correcting roller 94. Meandering of the fixing belt 84 is controlled by this axially displacing mechanism.

The peeling pad 96 is, as an example, a block-shaped member that is formed by a rigid body of an iron-based metal or a resin or the like, and that has a length corresponding to that of the heating roller 89. The cross-sectional shape of the peeling pad 96 exhibits a substantial arc shape that is structured by an inner side surface 96A, a pushing surface 96B and an outer side surface 96C. The inner side surface 96A is a curved surface that faces the heating roller 89. The pushing surface 96B pushes the fixing belt 84 toward the pressure-applying roller 88. The outer side surface 96C has a determined angle with respect to the pushing surface 96B, and bends the fixing belt 84. In detail, a corner portion U, that is structured from the pushing surface 96B and the outer side surface 96C, bends the fixing belt 84 that is pushed-against the corner portion U by the pressure-applying roller 88, and, when the leading end of the sheet member P passes by the corner portion U, the leading end of the sheet member P and the fixing belt 84 are peeled apart.

On the other hand, the pressure-applying roller 88 is structured with a solid-cylindrical roller 88A that is formed of aluminum being the base thereof, and by an elastic layer 88B formed from silicone rubber, and a releasing layer formed from a fluorine based resin and having a film thickness of 100 μm, being layered in that order from the base side. The pressure-applying roller 88 is supported so as to rotate freely. Due to an urging portion such as an unillustrated spring or the like, the pressure-applying roller 88 is made to press-contact the region where the fixing belt 84 is trained around the heating roller 89. Due thereto, as the heating roller 89 of the fixing belt module 86 rotates in the direction of arrow C, the pressure-applying roller 88 is driven by the heating roller 89 and rotates in the direction of arrow E.

As shown in FIG. 1, a conveying device 108, that conveys downstream the sheet member P that is fed-out from the fixing unit 82, is provided at the downstream side of the fixing unit 82. A cooling unit 110, that cools the sheet member P that was heated by the fixing unit 82, is provided at the downstream side of the conveying device 108. At the cooling unit 110, an absorbing device 112 that absorbs the heat of the sheet member P is provided above the conveying path 60, and a pushing device 114 that pushes the conveyed sheet member P against the absorbing device 112 is provided beneath the conveying path 60. Further, a de-curling processing unit 140, that corrects the curving of the sheet member P, is provided at the downstream side of the cooling unit 110.

An absorbing belt 116, that is endless and contacts the sheet member P and absorbs the heat of the sheet member P, is provided at the absorbing device 112. Plural supporting rollers 118 that support the absorbing belt 116, and a driving roller 120 that transfers driving force to the absorbing belt 116, are provided at the inner side of the absorbing belt 116. Further, a heat sink 112, that is formed of an aluminum material and planarly contacts the absorbing belt 116 and dissipates the heat that the absorbing belt 116 has absorbed, is provided at the inner side of the absorbing belt 116.

A pushing belt 130, that is endless and contacts the sheet member P and pushes the sheet member P against the absorbing device 112, and plural supporting rollers 132, by which the pushing belt 130 is stretched and is supported so as to be rotated, are provided at the pushing device 114. Due to these structures, the heat of the sheet member P is taken, and the sheet member P is cooled.

Discharging rollers 197, that discharge the sheet member P, on whose one side an image has been formed, out to a discharging section 196 that is mounted to the side surface of the second processing section 10B, are provided downstream of the de-curling processing unit 140. Further, a temperature/humidity sensor 119, that serves as an example of a temperature/humidity measuring section and that measures the internal temperature and humidity of the second processing section 10B or the external temperature and humidity and sends the temperature and humidity data to the control section 13, is provided above the de-curling processing unit 140. Here, if images are to be formed on both surfaces of the sheet member P, the sheet member P is conveyed to an inverting unit 198 that is provided downstream of the de-curling processing unit 140.

An inverting path 199 is provided at the inverting unit 198. A forked-off path 199A, a sheet conveying path 199B, and an inversion path 199C are provided at the inverting path 199. The forked-off path 199A is a path that is forked-off from the conveying path 60. The sheet conveying path 199B is a path that conveys, toward the first processing section 10A side, the sheet member P that is conveyed along the forked-off path 199A. The inversion path 199C is a path that turns the sheet member P, that is conveyed along the sheet conveying path 199B, back in the opposite direction so as to switch-back and convey the sheet member P and invert the obverse and reverse thereof. Due to this structure, the sheet member P that is switched-back and conveyed at the inversion path 1990 is conveyed toward the first processing section 10A, and further, is fed into the conveying path 60 provided above the sheet feed cassettes 48 and is again fed to the transfer position T.

Operation of the heating controlling device 301 of the present exemplary embodiment is described next.

Figure 5:
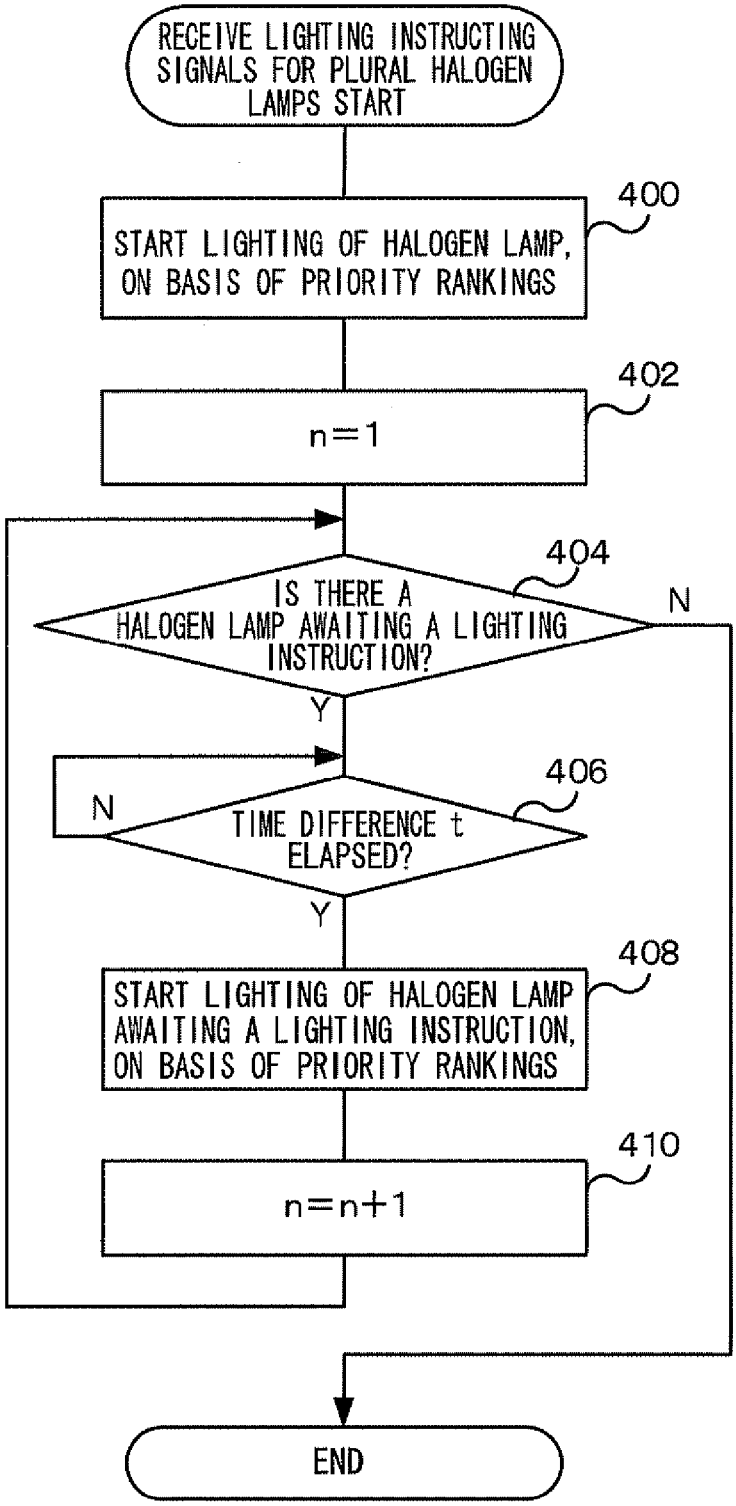
FIG. 5 is a flowchart of control processing that is executed when a control section relating to the present exemplary embodiment receives, at timings that are considered to be simultaneous, lighting instructing signals corresponding to plural halogen lamps, which processing is executed at the control section.

At the image forming device 10 of the present exemplary embodiment, as a concrete example, when the power of the image forming device 10 is turned on, or the like, lighting instructing signals for lighting the first main lamp 202, the first main lamp 212 and the first main lamp 222 are sent from the control section 13 to the control section 301. Therefore, first, a case in which the control section 301 receives lighting instructing signals corresponding to plural halogen lamps 320 from the control section 13 at timings that are considered to be simultaneous, is described. A flowchart of the control processing, that is executed when the control section 301 receives lighting instructing signals corresponding to plural halogen lamps 320 at timings that are considered to be simultaneous, is shown in FIG. 5.

When the control section 301 receives lighting instructing signals corresponding to the plural halogen lamps 320 at timings that are considered to be simultaneous, the control processing starts. In step 400, the control section 301 sends lighting starting instructions to the halogen lamps 320 on the basis of predetermined priority rankings.

Figure 7:
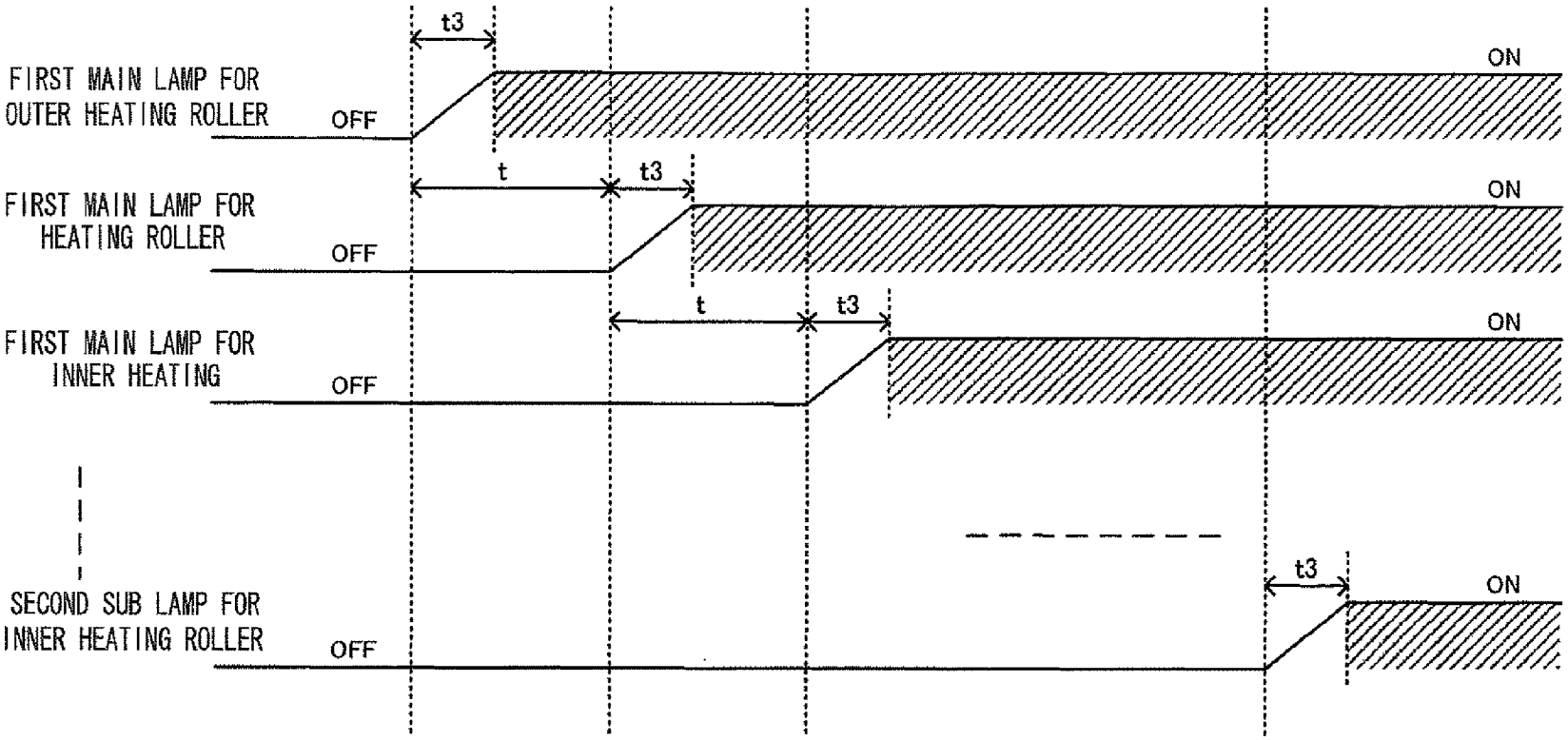
FIG. 7 is a timing chart for explaining starting of lighting of the halogen lamps relating to the present exemplary embodiment.

A concrete example of the priority rankings of the present exemplary embodiment is shown in FIG. 6. FIG. 6 shows the predetermined priority rankings of lighting of the respective halogen lamps 320. The priority rankings shown in FIG. 6 are stored in advance in the storage section 308. The control section 301 refers to the priority rankings, and selects the halogen lamp 320 that has the highest priority ranking among the halogen lamps 320 for which lighting instructing signals were received, and sends a lighting starting instruction to the selected halogen lamp 320 (the driving section of the halogen lamp). In the present exemplary embodiment, as shown in FIG. 7, the control section 301 also controls the rising rate such that the temperature rises at a rising rate that is set such that it takes a predetermined time period t3 to reach a predetermined temperature, so that the temperature of the halogen lamp 320 to which the lighting starting instruction is sent does not rise suddenly (so that the halogen lamp 320 does not emit light suddenly). Specifically, the control section 301 controls the driving circuit that drives the halogen lamp 320, and increases the energization rate of the halogen lamp 320 at a predetermined rate of increase. As a concrete example, in the present exemplary embodiment, the time period t3 is 150 ms. Note that the control section 301 effects control in this way such that the temperature does not rise suddenly not only in the present step, but also in cases in which a lighting starting instruction is sent to the halogen lamp 320 in the present exemplary embodiment. Due thereto, the halogen lamp 320 is not energized suddenly, and rush current is suppressed.

In next step 402, an unillustrated counter is set to n=1, and in subsequent step 404, it is judged whether or not there is a halogen lamp 320 that is waiting for a lighting instruction. If the number of times that a lighting instructing signal was received and the count number of the counter do not match (if the number of times of receipt is greater), there is a halogen lamp 320 for which a lighting starting instruction has not yet been sent, and therefore, the judgment is affirmative and the routine proceeds to step 406.

In step 406, it is judged whether a time difference t has elapsed. As shown in FIG. 7, in the present exemplary embodiment, a predetermined time period from the starting of lighting of one halogen lamp 320 to the starting of the next halogen lamp 320 is called the time difference t. The time difference t is a value that is determined in advance on the basis of the time period from the start of lighting of the halogen lamp 320, i.e., from the start of energizing, until the rush current generated by the energizing subsides. In the present exemplary embodiment, the time difference t is determined in advance from the state of the image forming device 10 or the like. As a concrete example, when the image forming device 10 is starting-up from a standby mode or the like in which it is temporarily low power, or when the image forming device 10 is in the midst of image formation, or the like, it is often the case that the halogen lamps 320 are warm, and therefore, the time difference t is set to 400 ms. On the other hand, when the power of the image forming device is turned on, the halogen lamps 320 are not warm, and the rush current is greater than in a case in which the halogen lamps 320 are warm, and therefore, the time difference t is set to 700 ms. Note that, in the present exemplary embodiment, as an example, the same numerical values are used for the time difference t and the time period t3 regardless of the type of the halogen lamp 320.

If the time difference t has not elapsed, the judgment is negative and the routine enters a standby state. When the time difference t elapses, the judgment is affirmative and the routine moves on to step 408.

In step 408, the halogen lamp 320 that is waiting for a lighting instruction is selected on the basis of the priority rankings shown in FIG. 6, and a lighting starting instruction is sent to the selected halogen lamp 320. In next step 410, the aforementioned unillustrated counter is incremented, the routine returns to step 404, and it is judged whether or not there is a halogen lamp 320 that is awaiting a lighting instruction. If there still is a halogen lamp 320 waiting for a lighting instruction, the processing of, after the time difference t elapses from the sending of the lighting starting instruction of the previous time, sending, on the basis of the priority rankings, a lighting starting instruction to the halogen lamp 320 that is waiting for a lighting instruction, is repeated.

On the other hand, in step 404, when the number of times that a lighting instructing signal was received and the count number of the counter match, there are no halogen lamps 320 to which a lighting starting instruction has not been sent, i.e., lighting starting instructions have been sent to all of the halogen lamps 320 corresponding to the received lighting instructing signals. Therefore, the judgment is negative, and the present processing ends.

In this way, when the control section 301 of the present exemplary embodiment receives lighting instructing signals corresponding to plural halogen lamps 320 at timings that are considered to be simultaneous, the control section 301 sends a lighting starting instruction to the corresponding halogen lamp 320 each time the time difference t elapses, on the basis of the priority rankings that are determined in advance for the respective types of the halogen lamps 320. Due to the control section 301 effecting control in this way, the plural halogen lamps 320 does not start lighting simultaneously, and therefore, voltage fluctuations due to rush current are suppressed as compared with a case in which plural halogen lamps are made to simultaneously start lighting.

Figure 8:
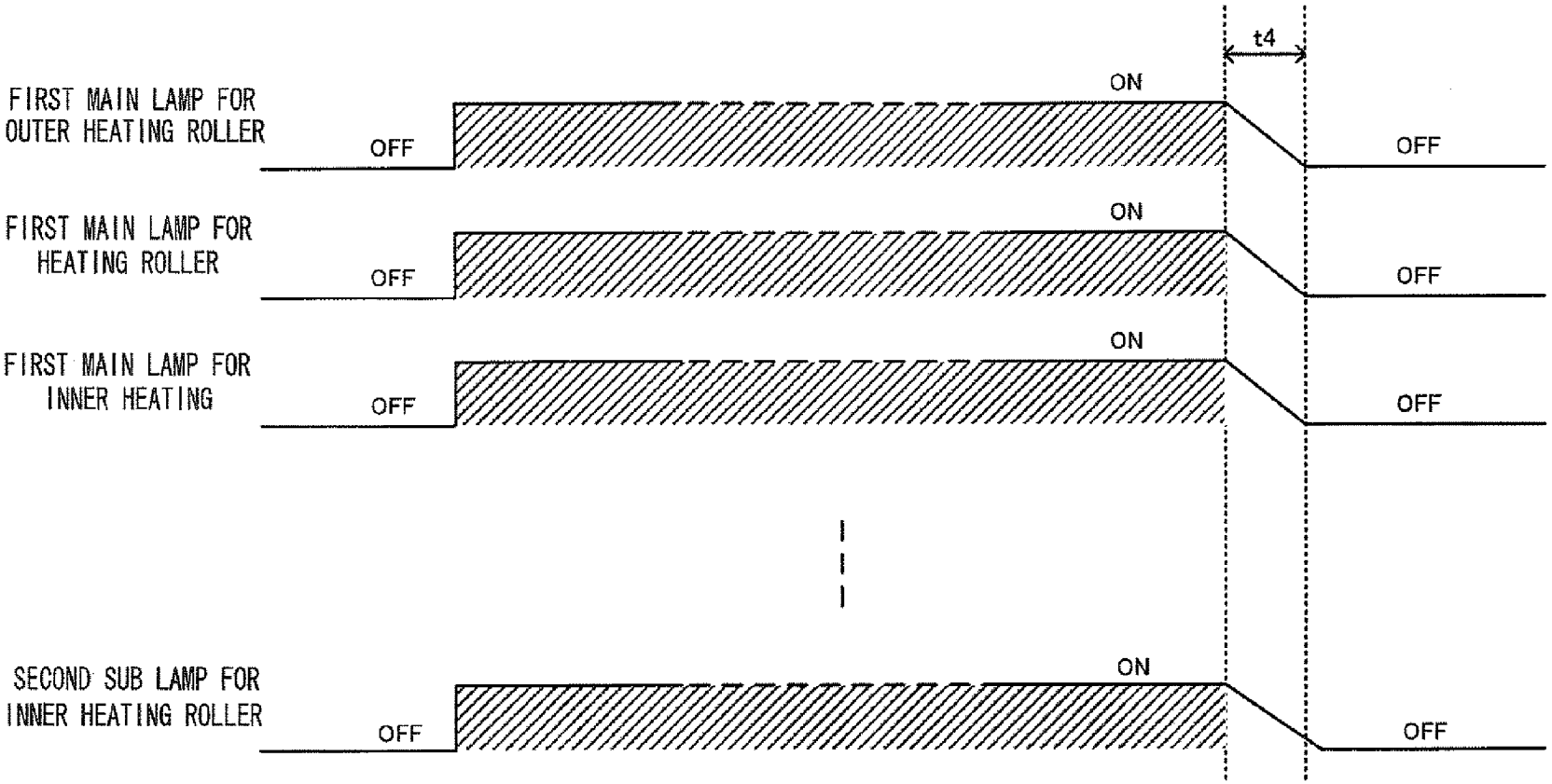
FIG. 8 is a timing chart for explaining stopping of the halogen lamps relating to the present exemplary embodiment.

When the control section 301 receives extinguishing instructing signals corresponding to plural halogen lamps 320 at timings that are considered to be simultaneous, as shown in FIG. 8, the control section 301 may send stop instructions, at timings that are considered to be simultaneous, to all of the halogen lamps 320 corresponding to the extinguishing instructing signals. Note that the control section 301 of the present exemplary embodiment controls the falling rate such that the temperature falls at a falling rate that is such that it takes a predetermined time period t4 to reach a predetermined temperature, so that the temperature of the halogen lamp 320 to which the stop instruction was sent does not fall suddenly (so that the halogen lamp 320 is not extinguished suddenly). Specifically, the control section 301 controls the driving circuit that drives the halogen lamp 320, and decreases the energization rate of the halogen lamp 320 at a predetermined rate of decrease. As a concrete example, in the present exemplary embodiment, the time period t4 is 100 ms. Due thereto, sudden changes in current do not arise at the halogen lamp 320, and therefore, voltage fluctuations are suppressed.

Note that, in the present exemplary embodiment, when the control section 301 receives, from the control section 13, a lighting instructing signal for the halogen lamp 320 for which the control section 301 is carrying out this temperature lowering control, the control section 301 sends, to the halogen lamp 320, a lighting starting instruction from the point of time of receiving that lighting instructing signal.

Figure 9:
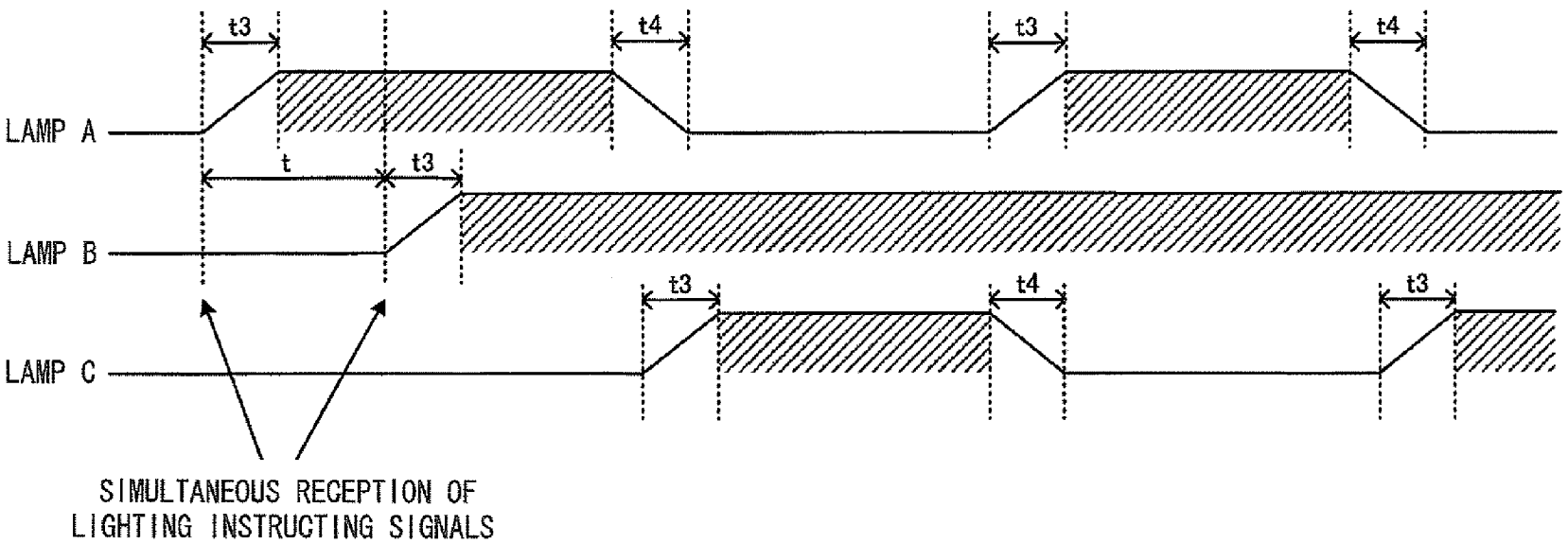
FIG. 9 is a timing chart for explaining starting of lighting and stopping of lighting of the halogen lamps relating to the present exemplary embodiment.

A case in which the control section 301 controls lamp A (any of the halogen lamps 320 whose priority ranking is the first rank through the ninth rank), lamp B (any of the halogen lamps whose priority ranking is the second rank through the tenth rank and is lower than that of lamp A), and lamp C as shown in FIG. 9, is described. When the control section 301 simultaneously receives lighting instructing signals for lamp A and lamp B, on the basis of the priority rankings, the control section 301 sends a lighting starting instruction to lamp A, and causes lamp A to become lit over the time period t3. Further, after the time difference t elapses from the sending of the lighting starting instruction to lamp A, the control section 301 sends a lighting starting instruction to lamp B and similarly effects control. Further, when the control section 301 receives an extinguishing instructing signal for lamp A from the control section 13, the control section 301 sends a stop instruction to lamp A, and causes lamp A to be extinguished over the time period t4. If, while controlling lamp A, the control section 301 receives a lighting instructing signal for lamp C, the control section 301 sends a lighting starting instruction to lamp C, and, in the same way as described above, causes lamp C to become lit over the time period t3. In this way, control of the rising rate of the temperature after the sending of a lighting starting instruction to the halogen lamp 320, and control of the falling rate of the temperature after the sending of a stop instruction to another halogen lamp 320, may be at the same timing.

Note that, if, in the midst of controlling the rising rate of the temperature after the sending of a lighting starting instruction to the halogen lamp 320, the control section 301 of the present exemplary embodiment receives an extinguishing instructing signal for that halogen lamp 320, the amount of change in current is small, and the amount of fluctuation in voltage arising due to the change in current is small. Therefore, the control section 301 stops the emission of light without carrying out control of the falling rate of the temperature as described above.

Figure 10:
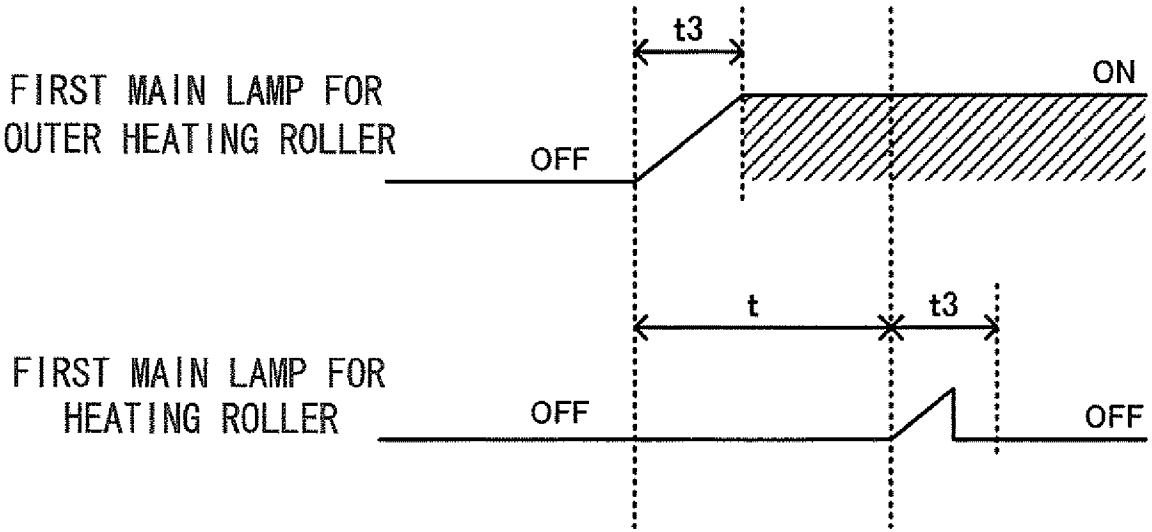
FIG. 10 is a timing chart for explaining a case of stopping a halogen lamp relating to the present exemplary embodiment during control of the temperature rising rate after a lighting starting instruction for that halogen lamp is sent.

Detailed explanation is given by using, as an example, the case of the first main lamp 202 for the outer heating roller and the first main lamp 212 for the heating roller shown in FIG. 7. As shown in FIG. 10, after the time difference t elapses from the sending of a lighting starting instruction to the first main lamp 202 for the outer heating roller, the control section 301 sends a lighting starting instruction to the first main lamp 212 for the heating roller. Then, if the control section 301 receives an extinguishing instructing signal for the first main lamp 212 for the heating roller during the period of time until the time period t3, that is from the sending of that lighting starting instruction until the lighting of the first main lamp 212 for the heating roller is completed, elapses, the control section 301 stops the lighting without carrying out control of the falling rate. Concretely, the control section 301 stops the energizing of the driving circuit, that corresponds to the first main lamp 212 for the heating roller, of the lamp driving section 304 for inner heating roller heating.

Figure 11:
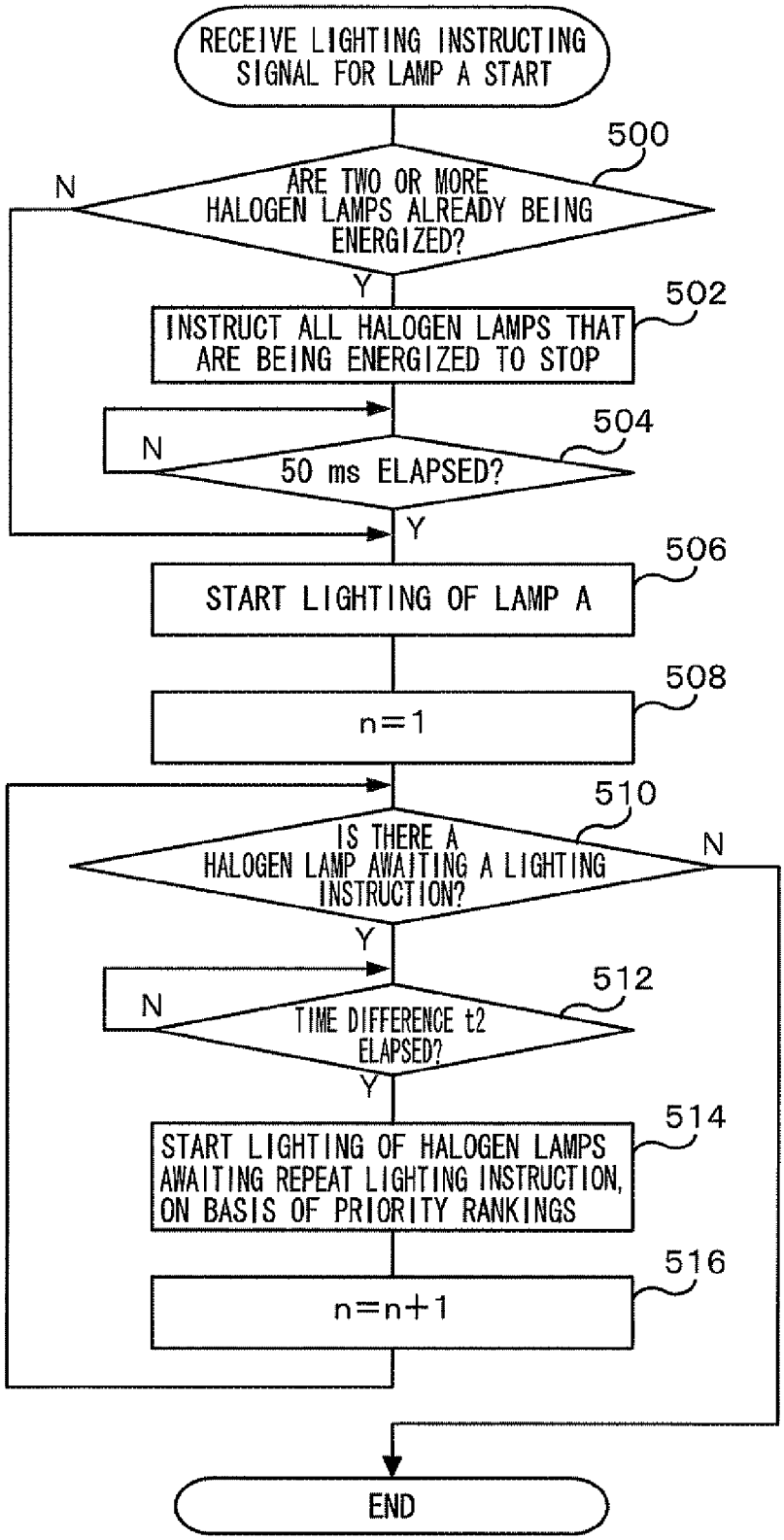
FIG. 11 is a flowchart of control processing that is executed when, during the time during which plural halogen lamps are lighted, a lighting instruction for another halogen lamp is received, which processing is executed at the control section relating to the present exemplary embodiment.

Next, explanation is given of a case in which, while the plural halogen lamps 320 are lit, the control section 301 receives a lighting instruction for another halogen lamp 320 from the control section 13. FIG. 11 shows a flowchart of control processing that is executed when, while plural halogen lamps are lit, the control section 301 receives a lighting instruction for another halogen lamp (which, for convenience, is called lamp A here). Note that step 508 in the flowchart of FIG. 11 corresponds to step 402 of the flowchart of FIG. 5, step 510 corresponds to step 404, step 512 corresponds to step 406, step 514 corresponds to step 408, and step 516 corresponds to step 410. Therefore, detailed description thereof is omitted here.

The control processing starts when the control section 301 receives a lighting instruction for lamp A. In step 500, it is judged whether or not two or more (a plural) halogen lamps 320 are already being energized (whether or not lighting instructing starting instructions are sent). If two or more of the halogen lamps 320 are not being energized, the routine moves on to step 506. On the other hand, if two or more of the halogen lamps 320 are being energized, the routine moves on to step 502, and stop instructions are sent to all of the halogen lamps 320 that are being energized.

In step 504, it is judged whether or not 50 ms has elapsed from the sending of the stop instructions. Note that 50 ms is used as a concrete example in the present exemplary embodiment. However, the present invention is not limited to the same, and it suffices to determine this value by taking into consideration the time period in which the voltage fluctuations, that accompany stopping of the halogen lamps 320 that are lit, abate. If 50 ms has not elapsed, the judgment is negative, and the routine enters a standby state. When 50 ms elapses, the judgment is affirmative, and the routine moves on to step 506.

In step 506, a lighting starting instruction is sent to lamp A, and in next step 508, the unillustrated counter is set to n=1. In subsequent step 510, it is judged whether or not there is a halogen lamp 320 that is awaiting a lighting instruction. If the halogen lamps 320 to which stop instructions were sent in step 502, or a halogen lamp 320 for which a lighting instructing signal has been received but to which a lighting starting instruction was not sent before the receipt of the lighting instructing signal for lamp A, is still waiting for a lighting starting instruction, the judgment is affirmative and the routine moves on to step 512, and it is judged whether or not time difference t2 has elapsed. Note that, in the present exemplary embodiment, concretely, the same value as the aforementioned time difference t is used for the time difference t2, but the present invention is not limited to the same and a different value may be used.

In step 512, if the time difference t2 has not elapsed, the judgment is negative, and the routine enters a standby state.

When the time difference t2 elapses, the judgment is affirmative, and the routine moves on to step 514. In step 514, on the basis of the predetermined priority rankings, the halogen lamp 320 that is awaiting a lighting instruction is selected, and a lighting starting instruction is sent thereto. In next step 516, the counter is incremented, and the routine returns to step 510 and the present processing is repeated. On the other hand, if it is judged in step 510 that there are no halogen lamps 320 that are waiting for a lighting instruction, the judgment is negative and the present processing ends.

Figure 12:
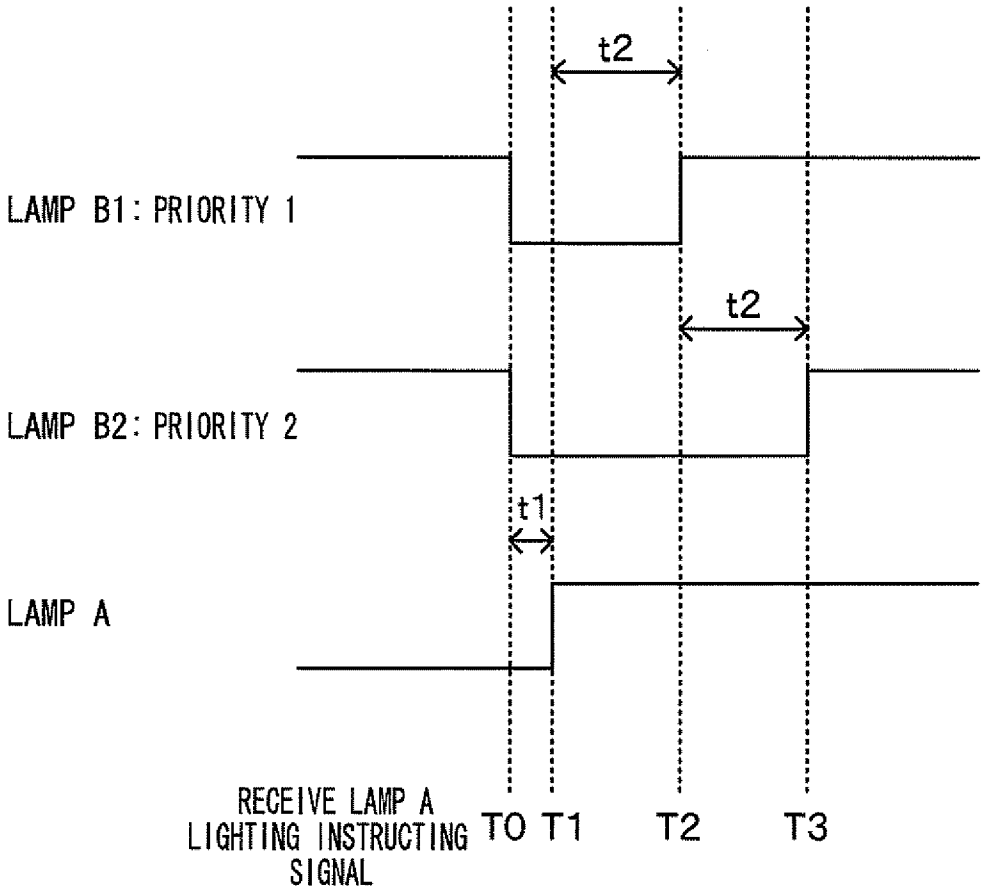
FIG. 12 is a timing chart for concretely explaining the control processing that is shown in FIG. 11 and relates to the present exemplary embodiment.
Figure 13:
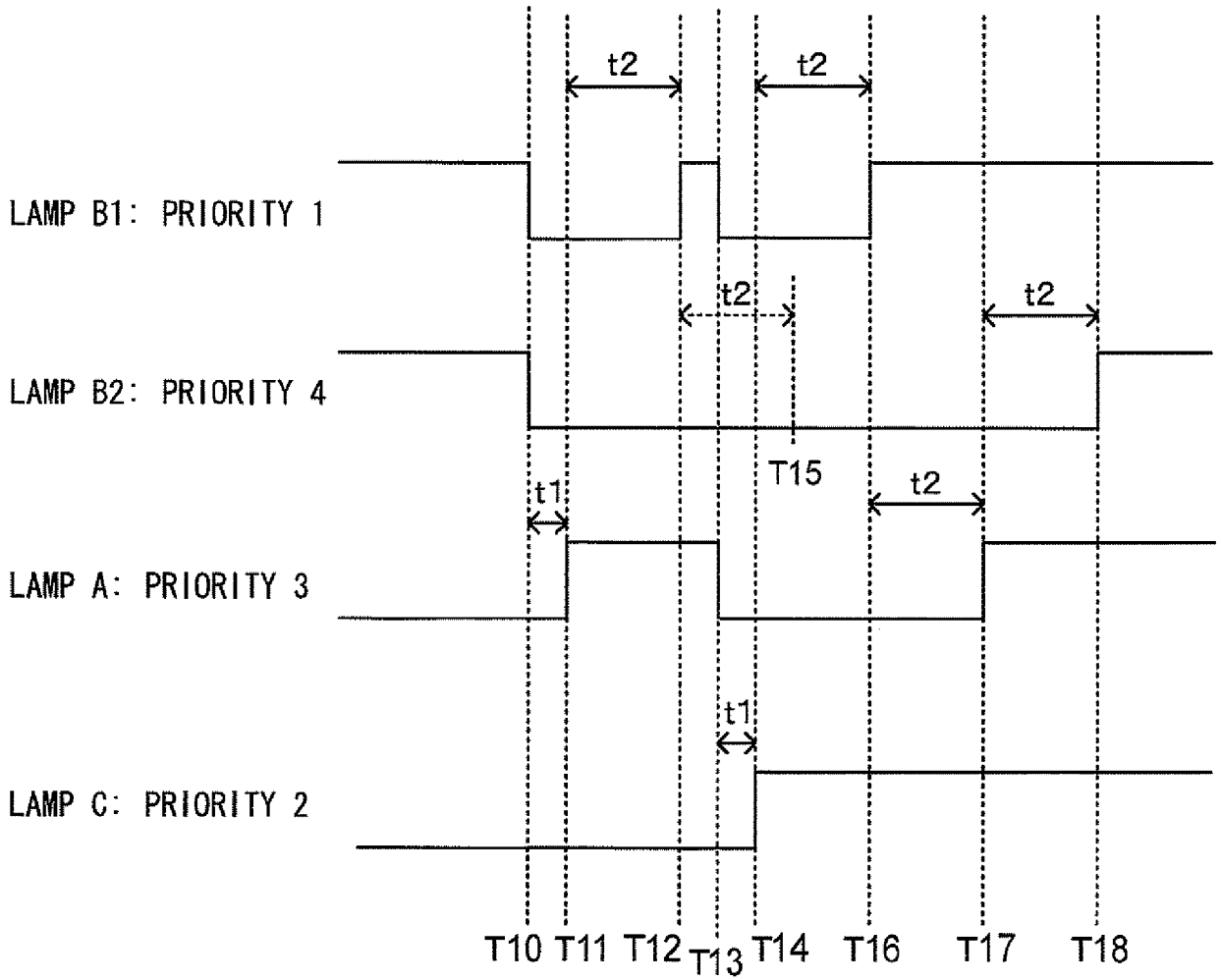
FIG. 13 is a timing chart for concretely explaining the control processing that is shown in FIG. 11 and relates to the present exemplary embodiment.
Figure 14:
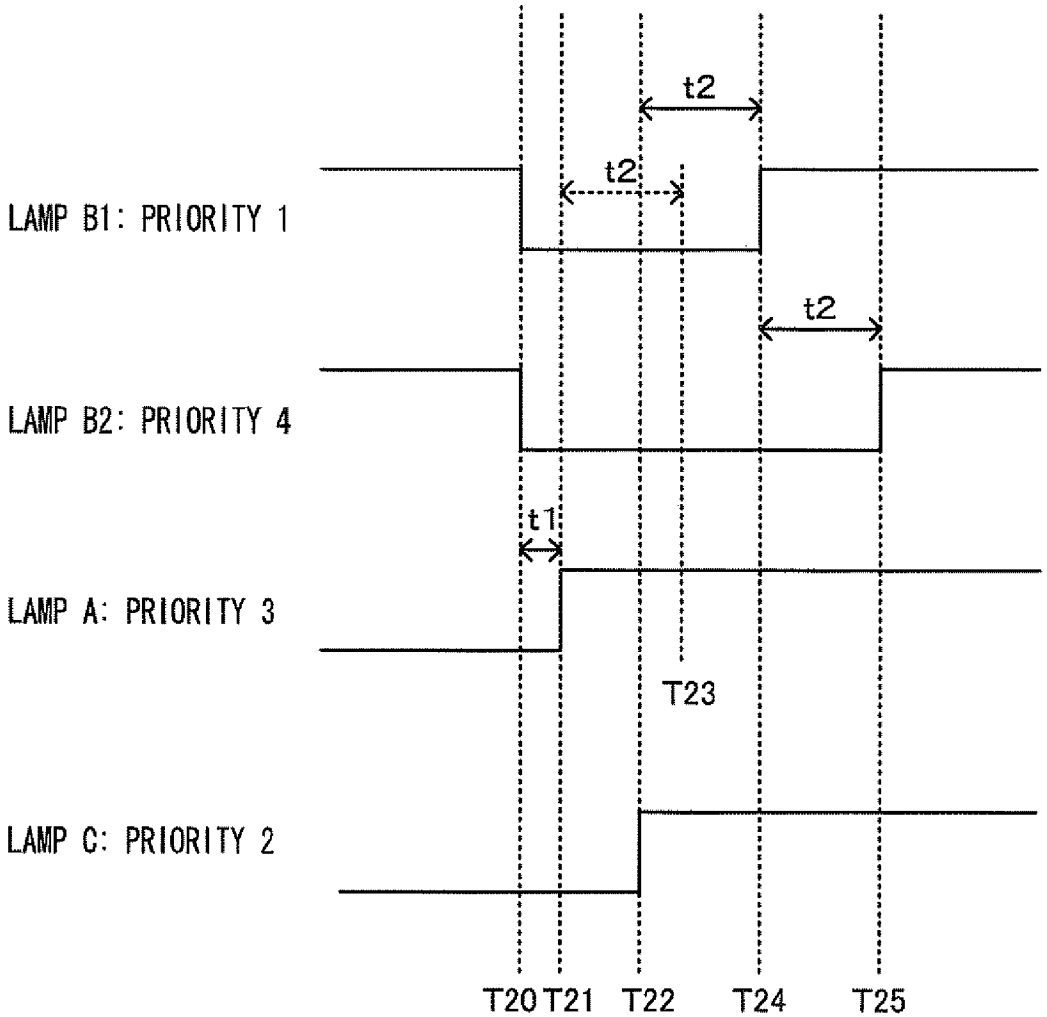
FIG. 14 is a timing chart for concretely explaining the control processing that is shown in FIG. 11 and relates to the present exemplary embodiment.

This processing is described concretely with reference to the timing charts shown in FIG. 12 through FIG. 14. Note that, in FIG. 12 through FIG. 14, in order to keep illustration from becoming complicated, only the timings at which the control section 301 sends lighting starting instructions and the timings at which the control section 301 sends stop instructions are illustrated. However, in all of these cases as well, the control section 301 is also carrying out control of the rising rate of the temperature after the sending of a lighting starting instruction and control of the falling rate of the temperature after the sending of a stop instruction.

FIG. 12 shows a timing chart in a case in which, during the lighting of lamp B1 and lamp B2, the control section 301 receives a lighting instructing signal for lamp A. Note that the priority ranking of lamp B1 is higher than the priority ranking of lamp B2. As shown in FIG. 12, when the control section 301 receives a lighting instruction for lamp A, the control section 301 sends stop instructions to lamp B1 and lamp B2 (timing T0).

At timing T1 when time period t1 (50 ms in the present exemplary embodiment) has elapsed from the timing T0, the control section 301 sends a lighting starting instruction to lamp A. When the time difference t2 elapses from timing T1, first, the control section 301 sends a lighting starting instruction to the lamp B1 that has the high priority ranking (timing T2). Then, when the time difference t2 elapses from the timing T2, the control section 301 sends a lighting starting instruction to the lamp B2 (timing T3). In this way, the control section 301 effects control such that lamp A, lamp B1 and lamp B2 do not start lighting simultaneously.

On the other hand, FIG. 13 shows a timing chart in a case in which, while lamp B1 and lamp B2 are lit, after the control section 301 receives a lighting instructing signal for lamp A, while lamp B2 is standing-by for lighting, the control section 301 receives a lighting instructing signal for new lamp C. Note that the priority rankings of the lamps are, in order from highest to lowest: lamp B1, lamp C, lamp A, lamp B2. As shown in FIG. 13, when the control section 301 receives a lighting instruction for lamp A, the control section 301 sends stop instructions to lamp B1 and lamp B2 (timing T10).

At timing T11 when the time period t1 has elapsed from the timing T10, the control section 301 sends a lighting starting instruction to lamp A. When the time difference t2 elapses from the timing T1, the control section 301 sends (timing T12) a lighting starting instruction to the lamp B1 whose priority ranking is higher than that of lamp B2. When the control section 301 receives a lighting instructing signal for lamp C before timing T15 which is when the time difference t2 elapses from the timing T12, when the control section 301 receives that lighting instructing signal for lamp C, the control section 301 sends (timing T13) stop instructions to lamp A and lamp B1 that are lit.

At timing T14 when the time period t1 has elapsed from the timing T13, the control section 301 sends a lighting starting instruction to lamp C. Because lamp A, lamp B1 and lamp B2 are in states of waiting for a lighting instruction, when the time difference t2 elapses from the timing T14, the control section 301 sends (timing T16) a lighting starting instruction to lamp B1 that has the highest priority ranking, on the basis of the priority rankings. Further, when the time difference t2 elapses from the timing T16, the control section 301 sends (timing T17) a lighting starting instruction to lamp A that has the next highest priority ranking among the halogen lamps 320 that are standing-by. Still further, when the time difference t2 elapses from the timing T17, the control section 301 sends (timing T18) a lighting starting instruction to lamp C. In this way, the control section 301 effects control such that lamp A, lamp B1, lamp B2 and lamp C do not start lighting simultaneously.

On the other hand, FIG. 14 shows a timing chart in a case in which, while lamp B1 and lamp B2 are lit, after the control section 301 receives a lighting instructing signal for lamp A, while lamp B1 and B2 are standing-by for lighting, the control section 301 receives a lighting instructing signal for new lamp C. Note that the priority rankings are the same as in the case shown in FIG. 13. As shown in FIG. 14, when the control section 301 receives a lighting instruction for lamp A, the control section 301 sends stop instructions to lamp B1 and lamp B2 (timing T20).

At timing T21 when the time period t1 has elapsed from the timing T20, the control section 301 sends a lighting starting instruction to lamp A. The control section 301 receives a lighting instructing signal for lamp C, before timing T23 is reached which is when the time difference t2 elapses from the timing T21 and is when a lighting starting instruction is to be sent to lamp B1. At this time, the only lamp is that lit is lamp A, and this is not a case in which the plural halogen lamps 320 are lit (are being energized). Therefore, the control section 301 sends (timing T22) a lighting starting instruction to lamp C without waiting for the time period t1 to elapse.

Lamp B1 and lamp B2 are in states of waiting for a lighting instruction. Therefore, on the basis of the priority rankings, when the time difference t2 elapses from the timing T22, the control section 301 sends (timing T24) a lighting starting instruction to lamp B1, and further, when the time difference t2 elapses from the timing T24, the control section 301 sends (timing T25) a lighting starting instruction to lamp B2. In this way, the control section 301 effects control such that lamp A, lamp B1, lamp B2 and lamp C do not start lighting simultaneously.

As described above, in the present exemplary embodiment, when, while plural halogen lamps 320 are lit, the control section 301 receives a lighting instructing signal for yet another of the halogen lamps 320 (lamp A in FIG. 11), the control section 301 sends stop signals to and extinguishes the halogen lamps 320 that are already lit, and, after time period t1 elapses from the sending of the stop signals, the control section 301 sends a lighting starting instruction to the halogen lamp 320 for which the lighting instructing signal was received. Further, each time a number of the time difference t2 elapses from the sending of the lighting starting instruction, the control section 301 sends a lighting starting signal on the basis of the predetermined priority rankings for the halogen lamps 320 that are in states of standing-by for a lighting instruction, such as the halogen lamps 320 whose lighting has been stopped or the like.

Due to the control section 301 effecting control in this way, the plural halogen lamps 320 do not start lighting simultaneously. Therefore, fluctuations in voltage due to rush current are suppressed as compared with a case in which plural halogen lamps are made to simultaneously start lighting.

Further, in the present exemplary embodiment, after the control section 301 sends a stop instruction to the halogen lamp 320, first, the control section 301 sends a lighting starting instruction to the halogen lamp 320 (lamp A) for which a lighting starting instruction was received, and thereafter, the control section 301 sends a lighting starting instruction for the halogen lamp 320 that is standing-by. Therefore, rush current is suppressed. Lamp B1 and lamp B2, whose lighting was stopped, are warm, but lamp A that receives a lighting starting instruction was not lit, and therefore, there are cases in which lamp A is not warmer than lamp B1 and lamp B2. A case in which a lamp is not warm results in the rush current being large. Therefore, by first sending a lighting starting instruction to lamp A which is probably not warm, rush current is suppressed.

What is claimed is:

1. A heating controlling device comprising:

a receiving section receiving heating instructions for a plurality of heaters; and a controller that, when the receiving section receives an activation instruction for a deactivated heater while two or more heaters other than the heater for which the activation instruction is received are active, deactivates the two or more heaters that are active, and, after a first predetermined time period elapses from deactivating the two or more heaters, the first predetermined time period thus creating a delay from receiving the activation instruction, activates the heater for which the activation instruction is received, and, each time a number of second predetermined time periods elapses from activating the heater for which the activation instruction is received, reactivates, on the basis of predetermined priority rankings, the two or more heaters that have been deactivated.

2. The heating controlling device of claim 1, wherein, when the receiving section receives activation instructions for the plurality of heaters, the controller activates the plurality of heaters for which the activation instructions were received, each time a number of the second predetermined time periods elapses and on the basis of the predetermined priority rankings.

3. The heating controlling device of claim 1, wherein the controller controls a heater that has been activated, such that a temperature of the heater that has been activated rises to a predetermined heating temperature over a predetermined heating time period.

4. The heating controlling device of claim 1, wherein the controller controls a heater that has been deactivated, such that a temperature of the heater that has been deactivated falls to a predetermined decreased temperature over a predetermined falling time period.

5. The heating controlling device of claim 4, wherein, if the receiving section receives a deactivation instruction for the heater while a temperature of the heater is being raised, the controller controls the heater such that the temperature of the heater falls to the predetermined decreased temperature in a time period that is shorter than the predetermined falling time period.

6. A heating device comprising:

the plurality of heaters; and the heating controlling device of claim 1 that controls heating of the plurality of heaters.

7. An image forming device comprising:

an image forming section forming an image on a recording medium;

a fixing section fixing, on the recording medium, the image that was formed by the image forming section; and the heating device of claim 6, the heating device heating the fixing section of the image forming device.

8. The heating controlling device of claim 1, wherein the controller reactivates the two or more heaters that have been deactivated during a period in which the heater for which the activation instruction is received is continuously active.

9. A non-transitory computer readable storage medium storing a program that executes heating control of an image forming device, the heating control comprising:

receiving heating instructions for a plurality of heaters;

when the receiving section receives an activation instruction for a deactivated heater while two or more heaters other than the heater for which the activation instruction is received are active, deactivating the two or more heaters that are active;

after a first predetermined time period elapses from deactivating the two or more heaters that are active, the first predetermined time period thus creating a delay from receiving the activation instruction, activating the heater for which the activation instruction is received; and each time a number of second predetermined time periods elapses from activating the heater for which the activation instruction is received, reactivating, on the basis of predetermined priority rankings, the two or more heaters that have been deactivated.

10. The non-transitory computer readable storage medium of claim 9, wherein the heating control further comprises:

when activation instructions for the plurality of heaters are received, activating the plurality of heaters for which the activation instructions were received, each time a number of the second predetermined time periods elapses and on the basis of the predetermined priority rankings.

11. The non-transitory computer readable storage medium of claim 9, wherein the heating control further comprises:

controlling a heater, that has been activated, such that a temperature of the heater that has been activated rises to a predetermined heating temperature in a predetermined heating time period.

12. The non-transitory computer readable storage medium of claim 9, wherein the heating control further comprises:

controlling a heater, that has been deactivated, such that a temperature of the heater that has been deactivated falls to a predetermined decreased temperature in a predetermined falling time period.

13. The non-transitory computer readable storage medium of claim 9, wherein the heating control further comprises:

if a deactivation instruction for a heater is received while a temperature of the heater is being raised, controlling the heater such that the temperature of the heater falls to the predetermined decreased temperature in a time period that is shorter than the predetermined falling time period.

14. The non-transitory computer readable storage medium of claim 9, wherein the heating control further comprises:

reactivating the two or more heaters that have been deactivated during a period in which the heater for which the activation instruction is received is continuously active.

15. A heating controlling method of an image forming device, the method comprising:

receiving heating instructions for a plurality of heaters;

when the receiving section receives an activation instruction to activate a deactivated heater while two or more heaters other than the heater for which the activation instruction is received are active, deactivating the two or more heaters that are active;

after a first predetermined time period elapses from deactivating the two or more heaters that are active, the first predetermined time period thus creating a delay from receiving the activation instruction, activating the heater for which the activation instruction is received; and each time a number of second predetermined time periods elapses from activating the heater for which the activation instruction is received, reactivating, on the basis of predetermined priority rankings, the two or more heaters that have been deactivated.

16. The heating controlling method of an image forming device of claim 15, further comprising:

when activation instructions for the plurality of heaters are received, activating the plurality of heaters for which the activation instructions were received, each time the second predetermined time period elapses and on the basis of the predetermined priority rankings.

17. The heating controlling method of an image forming device of claim 15, further comprising:

controlling a heater, that has been activated, such that a temperature of the heater that has been activated rises to a predetermined heating temperature in a predetermined heating time period.

18. The heating controlling method of an image forming device of claim 15, further comprising:

controlling a heater, that has been made to deactivate, such that a temperature of the heater that has been made to deactivate falls to a predetermined decreased temperature in a predetermined falling time period.

19. The heating controlling method of an image forming device of claim 15, further comprising:

if a deactivation instruction for a heater is received while a temperature of the heater is being raised, controlling the heater such that the temperature of the heater falls to the predetermined decreased temperature in a time period that is shorter than the predetermined falling time period.

20. The heating controlling method of an image forming device of claim 15, further comprising:

reactivating the two or more heaters that have been deactivated during a period in which the heater for which the activation instruction is received is continuously active.

* * * * *